US005165346A

United States Patent [19]

Piekarski

[11] Patent Number: 5,165,346

[45] Date of Patent: Nov. 24, 1992

[54] RAIL FASTENER APPLICATOR

[75] Inventor: Spishek J. Piekarski, Clearview, Australia

[73] Assignee: McKay Australia Limited, Maidstone, Australia

[21] Appl. No.: 621,016

[22] Filed: Nov. 30, 1990

[30] Foreign Application Priority Data

Dec. 6, 1989 [AU] Australia ..... PJ7737

[51] Int. Cl.[5] ..... E01B 29/32

[52] U.S. Cl. ..... 104/17.2; 238/351

[58] Field of Search ..... 104/17.2; 238/349, 350, 238/351

[56] References Cited

U.S. PATENT DOCUMENTS

| | | | |
|---|---|---|---|
| 1,607,644 | 11/1926 | Scholes | 104/17.2 X |
| 3,120,193 | 2/1964 | Pettigrew et al. | 104/17.2 |
| 3,841,221 | 10/1974 | Dieringer et al. | 104/17.2 |
| 4,068,593 | 1/1978 | Leeves | 104/17.2 X |
| 4,284,238 | 8/1987 | Veroef | 238/349 |
| 4,580,501 | 4/1986 | Collins et al. | 104/17.2 X |
| 4,685,618 | 8/1987 | Yang | 238/351 X |
| 4,688,719 | 8/1987 | Yang et al. | 238/351 |
| 5,003,888 | 4/1991 | Martin | 104/17.2 |

FOREIGN PATENT DOCUMENTS

| | | | |
|---|---|---|---|
| 793036 | 8/1968 | Canada | 104/17.2 |
| 211377 | 6/1984 | Fed. Rep. of Germany | 104/17.2 |
| 219515 | 3/1985 | Fed. Rep. of Germany | 104/17.2 |
| 722900 | 2/1955 | United Kingdom | 238/349 |
| 2129036 | 5/1984 | United Kingdom | 104/17.2 |

*Primary Examiner*—Michael S. Huppert
*Assistant Examiner*—Robert S. Katz
*Attorney, Agent, or Firm*—Hodgson, Russ, Andrews, Woods & Goodyear

[57] ABSTRACT

A manually operable applicator for applying rail fasteners in a direction lateral of the rail. The applicator comprises lever arm 20 which is pivoted on axle 26 and at its lower end has a latch 21 for urging a rail clip onto a rail flange. The bracing mechanism 23 has two arms pivoted on either side of the lever 20 which hook over the rail head. The location pin 29 bears against the rail clip and is engaged by the latch 21 to urge the clip onto the rail flange.

5 Claims, 3 Drawing Sheets

RAIL FASTENER APPLICATOR

BACKGROUND OF THE INVENTION

This invention relates to an applicator for applying rail fasteners of the kind that are applied laterally to the rail.

U.S. Pat, No. 4,494,463 discloses a power operated machine for applying a pair of fasteners on opposite sides of a rail. The basic action is that the fasteners are placed in position to be driven onto the rail flange where they are held in place by the rail fastener holder positioned adjacent to the rail. The applied force is to the back of the fastener which is the portion that seats on the holder. The toe of the fastener which holds the rail in position seats on the flange of the rail.

Other prior patents also disclose power operated machines which push the fasteners onto the holder and the rail flange. Typical of such prior art is U.S. Pat. Nos. 3,841,221 and 4,267,682.

The only alternative to using the power machines to apply fasteners is to use a sledge-hammer. Often it is more convenient in either track laying or track repair work to use manual labour with sledge-hammers to apply fasteners singly to one side of a rail at a time. The use of sledge-hammers entails a risk of damaging the rail fasteners or fastener holders if the force applied does not drive the clip at right angles to the rail.

SUMMARY OF THE INVENTION

It is an object of this invention to provide a portable manually operable applicator to apply rail fasteners laterally to rails.

To this end the present invention provides a manually operable rail fastener applicator for applying rail fasteners at right angles to the rail so a toe portion lies on the rail flange and the body portion is held in a rail fastener support adjacent said rail, said applicator comprising fastener applicator means comprising:

- a lever arm having at its lower end fastener urging means adapted to engage said fastener;
- bracing means which engages the rail to brace said applicator against the rail; and
- said lever arm having pivotally connected intermediate its length to said bracing means.

This arrangement enables the lever to be pulled away from the rail so that the lower end urges the fastener onto the rial flange. Preferably the urging means also acts to open the clip. This is achieved by using wedge shaped latch to drive the clip forward. The bracing means is consequently a hook or clamp which sits over the head of the rail.

DESCRIPTION OF THE PREFERRED EMBODIMENT

To ensure even application of force to the fastener it is preferred that the bracing means comprises a pair of hooks to fit over the rail head and the lever is pivotally mounted between them for movement in a plane perpendicular to the rail.

A preferred aspect of this invention is concerned with applying rail fasteners of the kind disclosed in U.S. Pat. Nos. 4,325,511 and 4,313,563 with fastener supports of the kind described in U.S. Pat. Nos. 4,284,238, 4,688,719, 4,576,334 and 4,685,618. These fasteners have a general D cross section and in plan view have two arms each in D cross section extending from a base which is held in the support. The ends of the two arms are curved backward and form the toe of the fastener which bears down on the rail flange.

The preferred applicator for this type of fastener further includes a location rod or bar connected by a pivoted connector to the bracing means. This helps in locating the applicator in the correct position. Movement of the lever causes the lower end of the lever to abut the rod or bar which in turn abuts the toe portion of the clip and the movement of the lever about its pivot axis results in the lower end urging the fastener onto the rail flange and into the support by applying the force to the toe position of the clip. By incorporating a wedge shape on the lower end of the lever the fit and movement of the lever tends to open the clip.

Figure 1:
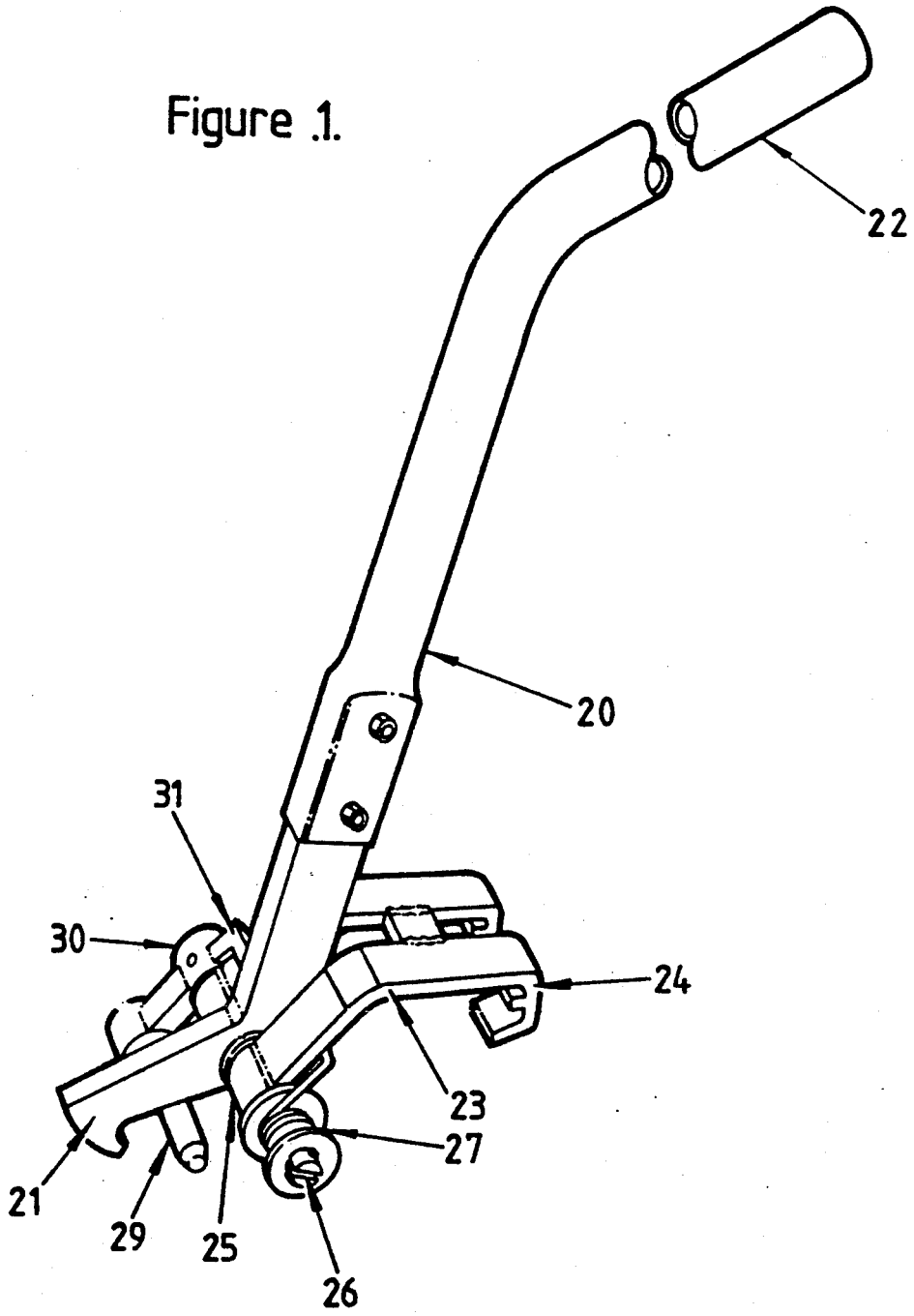
FIG. 1 is a perspective view of the rail fastener applicator.
Figure 3:
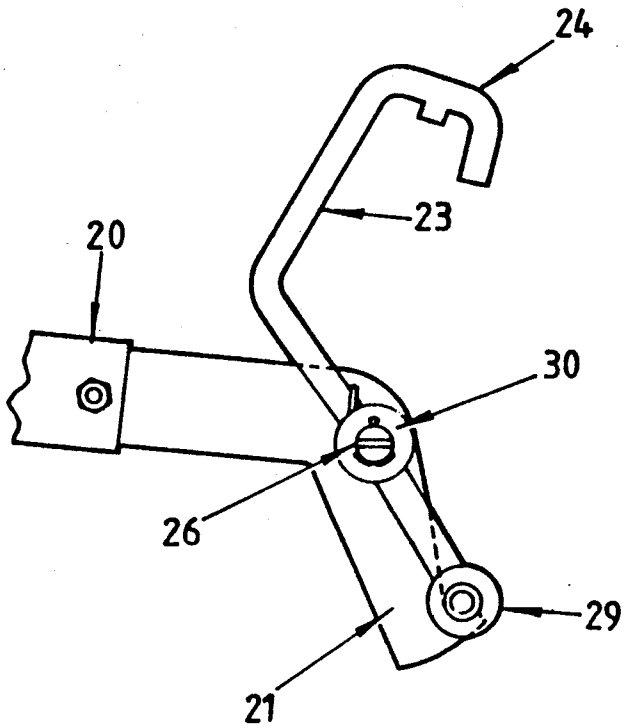
FIGS. 2 and 3 are front and side views respectively, of the applicator wedge, location pin, and hook.
Figure 2:
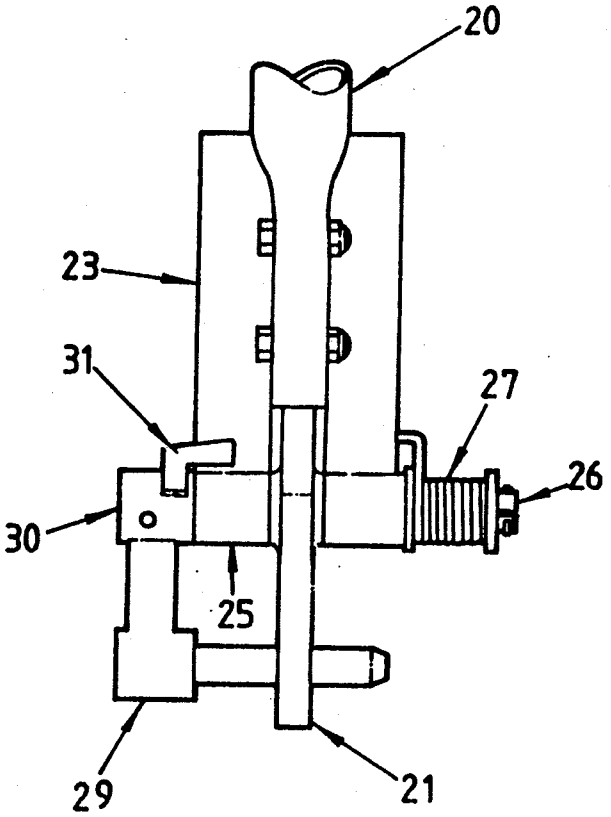
Figure 4:
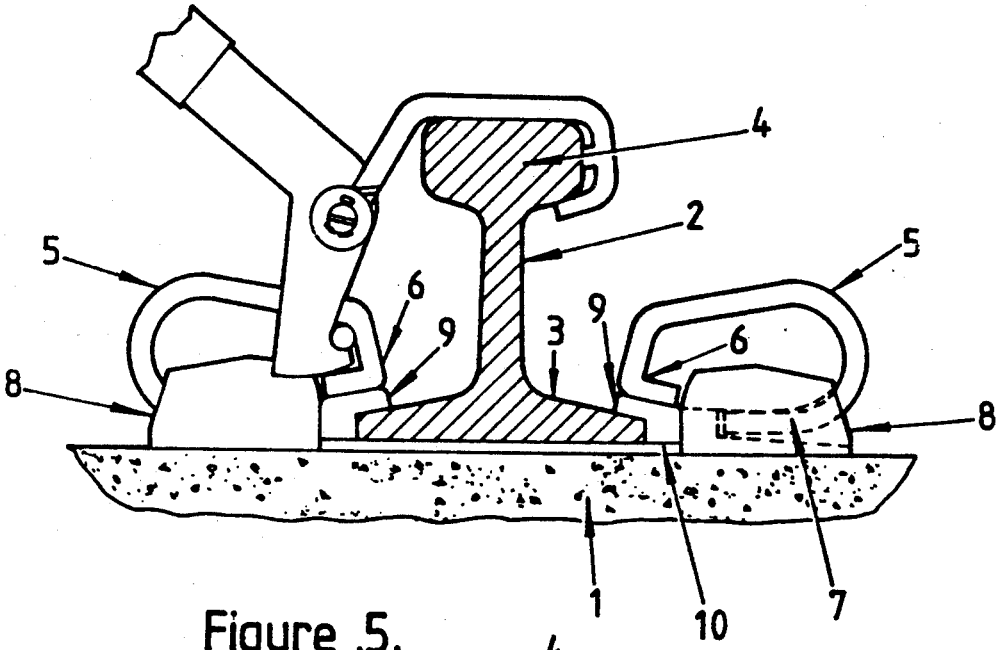
FIGS. 4 and 5 are side and top views of the applicator affixing a clip onto a rail flange.
Figure 5:
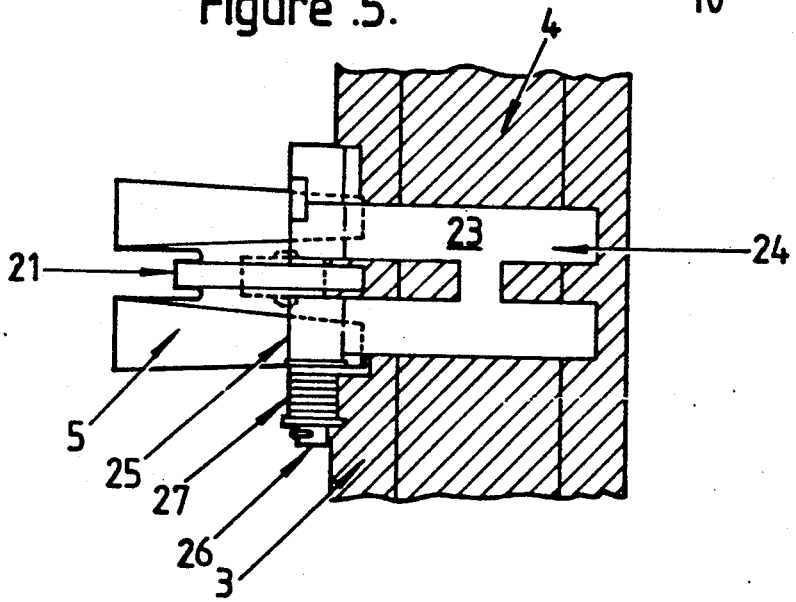

A preferred aspect of the invention will now be described with reference to the drawings in which FIG. 1 is a perspective view of the applicator and FIG. 2 and FIG. 3 are plan and side views respectively. FIGS. 4 and 5 are a side view and a plan view respectively of the applicator in operation in applying a rail clip to a rail.

The applicator as shown in FIGS. 1, 2 and 3 comprises the lever 20 having at its lower end a latch and wedge 21 for urging the clip onto the rail and partially opening the clip and at its upper end a handle portion 22. The lever 20 is mounted on the axle 26 for rotation. Also mounted on axle 26 is the bracing means 23 having the hook part on 24 for securing the head of the rail. The bracing means includes a pair of tubular sleeves 25 mounted on either side of the lever 20 on the axle 26. The spring 27 maintains the bracing means 23 in a preferred position relative to the lever 20.

Also mounted for rotation on axle 26 is the location pin 29 attached to the tubular sleeve 30 which fits onto axle 26. The stop 31 limits the degree of rotation of the location pin 29 relative to the bracing means 23.

Turning to FIGS. 4 and 5, the rail seat comprises a rail tie 1 on which lies the rail 2. The rail has a head 4 and a flange 3. The rail seats on a rail paid 10 interposed between the rail 2 and the rail tie 1 which are held in place by the rail clip 5. Interposed between the toe 6 of the rail clip 5 and the rail flange 3 is the insulator 9. The rail clip is supported by the support shoulder 8 embedded in the rail tie 1. Portion 7 of rail clip 5 seats in the support shoulder 8.

In order to apply the rail clip it is necessary to pull the toe end of the clip onto the insulator 9 as shown in FIG. 4. The two arms of the clip 5 are compressed as they are drawn through the tapered body of the shoulder 8 and spring apart once they pass onto the insulator 9 to prevent removal of the clip 5.

To apply the clip 5 the bracing means is attached to the rail head 4 and the locating pin 29 is placed behind the toe 6 of the rail clip. The lever 20 is then pulled down so that the latch 21 engages the pin 29. The wedge in latch 21 partially opens the clip by lifting toe 6 relative to the base portion 7 and drives the clip 5 forward by pushing the toe 6 onto the insulator 9.

The two arms of the bracing means 23 located on either side of the lever 20 ensures that the movement of the rail clip 5 is always D perpendicular to the longitudinal axis of the rail 2 to ensure accurate location of the clip 5 on the insulator 9.

I claim:

1. A manually operable rail fastener applicator for applying rail fasteners each having a toe portion and a body portion, at right angles to a rail having a longitudinal axis, and having a head and a flange, so as when installed the toe portion lies on the rail flange and the body portion is held in a rail fastener support adjacent the rail, said applicator comprising:

a lever arm having at its lower end fastener urging means adapted to engage said fastener;

bracing means which engages the rail head to brace said applicator against the rail; and said lever arm being pivotally connected intermediate its length to said bracing means whereby said lever arm is rotatable about an axis parallel to the longitudinal axis of the rail and to said bracing means, and said fastener urging means engaging the toe portion of said fastener to urge said fastener toward the rail and onto the rail flange.

2. A rail fastener applicator as claimed in claim 5 wherein the fastener urging means comprises a laterally disposed rod adapted to engage the toe portion of the rail fastener and the lower end of said lever arm abuts and engages said rod.

3. A rail fastener applicator as claimed in claim 2 wherein the lower end of said lever arm is profiled to provide a vertical as well as horizontal force to said rod to urge said toe portion upwardly and forwardly onto the rail flange.

4. A rail fastener as claimed in claim 5 wherein the bracing means comprises a pair of arms adapted to engage the head of the rail and said lever arm is pivotally mounted on an axial pin connected to said pair of arms.

5. A rail fastener applicator as claimed in claim 1 wherein the fastener urging means comprises a laterally disposed rod pivotally connected to said lever arm, said rod engages the toe portion of the rail fastener and the lower portion of said lever arm abuts, engages, and moves said rod.

* * * * *